United States Patent [19]

Pfender

[11] 4,365,657

[45] Dec. 28, 1982

[54] MACHINE FOR THE MANUFACTURE OF REINFORCING BODIES FOR CONCRETE PIPES

[75] Inventor: Georg Pfender, Kisslegg, Fed. Rep. of Germany

[73] Assignee: MBK Maschinenbau GmbH, Kisslegg, Fed. Rep. of Germany

[21] Appl. No.: 199,735

[22] Filed: Oct. 23, 1980

[30] Foreign Application Priority Data

Nov. 16, 1979 [DE] Fed. Rep. of Germany ..... 2946297

[51] Int. Cl.[3] ..... B21F 27/10

[52] U.S. Cl. ..... 140/112; 219/56

[58] Field of Search ..... 140/112; 219/56, 58

[56] References Cited

U.S. PATENT DOCUMENTS 3,718,797 2/1973 Pfender ..... 219/56

FOREIGN PATENT DOCUMENTS 49-13711 4/1974 Japan ..... 140/112

*Primary Examiner*—Lowell A. Larson

*Attorney, Agent, or Firm*—Amster, Rothstein & Engelberg

[57] ABSTRACT

A machine for the manufacture of reinforcing bodies for concrete pipes and the like, which comprises longitudinal bars and wire wound about the longitudinal bars. Two coaxial, synchronously driven discs are provided. A first disc carries radially displaceable guide pieces as a welding rest for the longitudinal bars. A welding device is mounted on a transversely moveable welding carriage and makes welds successively on the longitudinal bars. The guide pieces and the welding device are adjustable automatically and continuously over the total radial stroke given with a first disc of specific diameter. Traction lines guided by rollers in the longitudinal direction engage the guide pieces. An axially directed hydraulic cylinder drives the traction lines and a transversely directed hydraulic cylinder, synchronized with the axially directed cylinder, drives the welding carriage. It is consequently possible to produce in succession reinforcing bodies of selected diameters without loss of time for changeover.

3 Claims, 7 Drawing Figures

Figure 1:
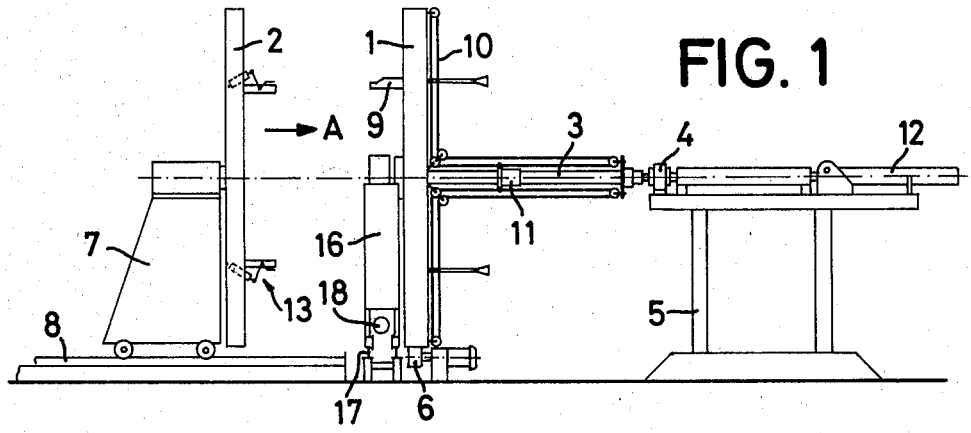

VI
VI
1
9
3
4
5
10
11
23
24
25
26
27
28
29
30
31
32
33
34
35
36
37
38
39
40
41
42

MACHINE FOR THE MANUFACTURE OF REINFORCING BODIES FOR CONCRETE PIPES

The invention relates to a machine for the manufacture of reinforcing bodies for concrete pipes, with the reinforcing bodies consisting of longitudinal bars and of wires which are wound over these and which are welded to these at the points of intersection, with the following features: A fixed main disc and an axially movable support disc are provided. The discs are mounted coaxially and are drivable synchronously. The main disc carries radially displaceable guide pieces as a welding rest for the longitudinal bars. There is provided a welding device which is mounted on a transversely movable welding carriage and which makes welds successively on the longitudinal bars. There is provided for the guide pieces and the welding carriage an adjusting drive which radially synchronises the guide pieces and the welding device.

Such a machine is known from German Offenlegungsschriften Nos. 2,008,095 and 2,014,719. Here, the guide pieces are displaced radially by means of spreader arms which constitute as a whole a conical shell and which connect each guide piece to a common axially movable control disc. The control disc is driven via a lever system from the drive of the support disc and the welding carriage is moved by means of a leading edge attached to said lever system.

The sole purpose of this known automatic radial adjustment consists in slightly enlarging the diameter of the reinforcing body at the start or at the end of the manufacturing process, namely, so that it corresponds to the shape of the socket of the subsequent concrete pipe. Accordingly, the radial stroke which can be executed automatically is relatively small.

The changeover of such a machine to reinforcing bodies of another diameter involves the necessity of exchanging the arms for those of another length or of hinging these at another point of the guide pieces or of the control disc. Furthermore, the welding device has accordingly to be adjusted constantly in the direction of movement, that is to say, in the radial direction, in respect of the welding carriage carrying same. Even with trained personnel this changeover requires at least half an hour of working time.

In the case of very large concrete pipes, two reinforcing bodies of different diameters which lie concentrically inside one another are necessary. Since these reinforcing bodies need a large amount of storage space, it is desirable to produce the large and small ones alternately and further process them immediately.

The object is therefore to make the guide pieces and the welding device adjustable automatically and continuously over the total radial stroke given with a main disc of specific diameter, so that it is consequently possible to produce in succession reinforcing bodies of different diameters without loss of time for the changeover, and, indeed, each with its corresponding socket shape.

This object is achieved according to the invention, starting from a machine of the abovementioned type, by means of the following features: Traction lines guided by means of rollers into the longitudinal direction engage on the guide pieces; an axially arranged working cylinder drives the traction lines and a transversely arranged working cylinder drives the welding carriage, and the working cylinders are designed and controlled hydraulically as synchronised cylinders.

It is admittedly already known, for example from German Offenlegungsschrift No. 2,360,532, to use an axially arranged hydraulic working cylinder for the radial adjustment of the guide pieces. However, because of the abovementioned spreader arms, its stroke movement is not proportional to the adjusting movement of the guide pieces. The advantage of the invention consists in that these movements are synchronous and, consequently, a further hydraulic working cylinder controlled synchronously can ensure the adjustment of the welding carriage. On the other hand, it is possible to move the guide pieces and the welding carriage infinitely variably in one movement within the total available radial distance, and, indeed, also in the case of very large machines with a disc diameter of more than four meters.

Suitable as traction lines are preferably endless chains which are carried along the spokes of the main disc and along a hollow shaft standing at the rear and are guided at the hub of the main disc via two rollers. The non-rotating piston rod of the working cylinder is linked to the chains, connected to one another by means of an annular sleeve, via an axial bearing and via a connecting rod which runs on the inside of the hollow shaft and which is connected fixedly to the annular sleeve through at least one longitudinal slot of the hollow shaft. The chains have a small weight and are insensitive to splashes of metal which are to be expected during welding.

Since the position of the guide pieces at any time is imaged in the stroke position of the working cylinders, the movement of the adjusting device into another position can be facilitated by means of position indicators which are arranged along one of the working cylinders. During the manufacture of a certain reinforcing body, these position indicators, acting in the manner of limit switches, limit the diameter pulse beats to the diameter of the reinforcing body downwardly and to the socket diameter upwardly. Preferably, the position indicators are attached so that they can be displaced easily and infinitely variably in the stroke direction.

Apart from the problem of clamping the longitudinal bars on the support disc, according to this proposal the changeover of the machine to another reinforcing body is restricted to the displacement of two position indicators. However, there can be provided, from the outset, further position indicators, for other reinforcing bodies, which are operated electrically. It is thereby possible, finally, to change the machine over in seconds "at the touch of a button" for the alternating production of different reinforcing bodies.

Figure 2:
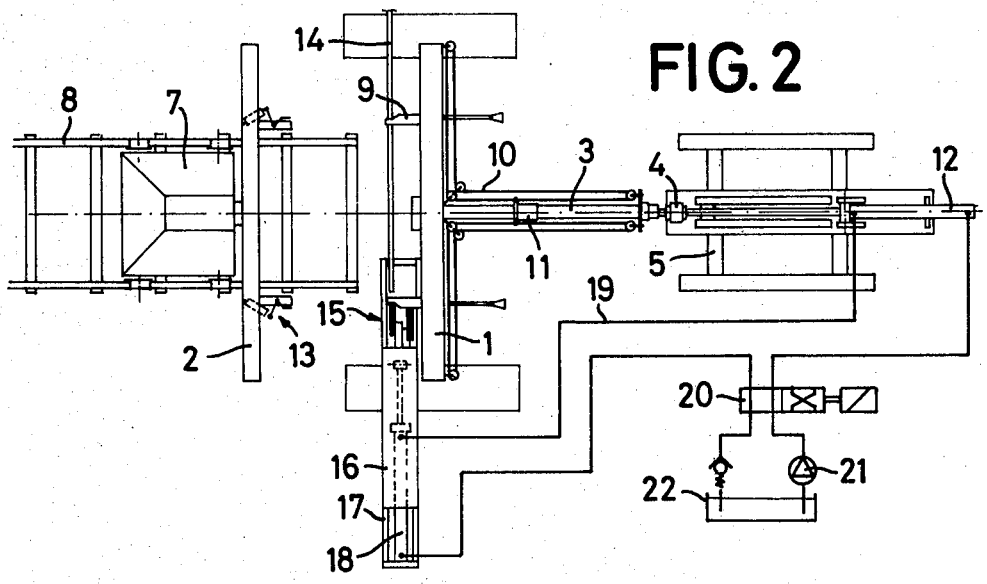
Figure 3:
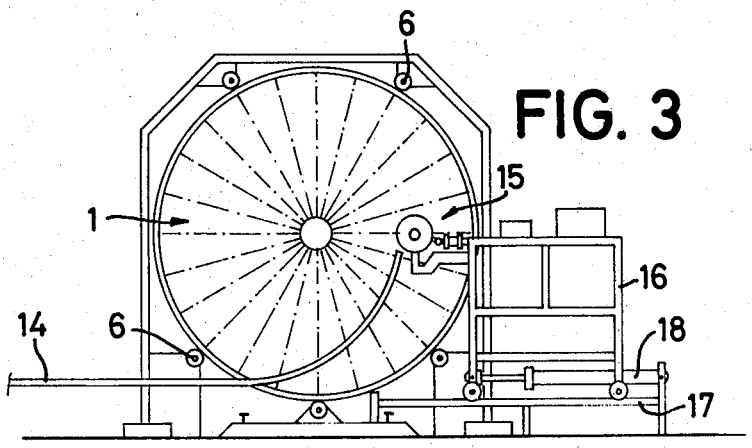
Figures 4, 6:
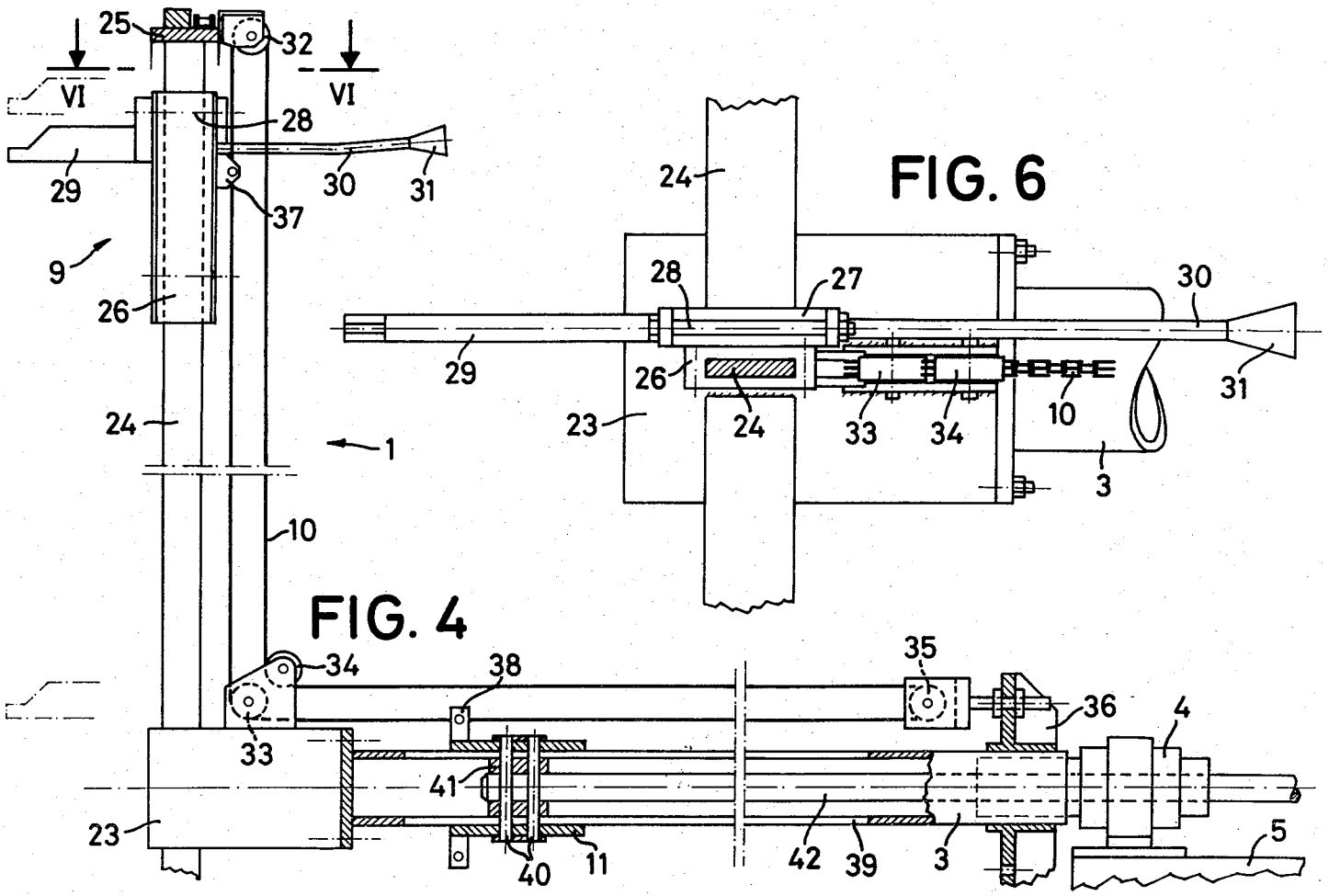
Figure 5:
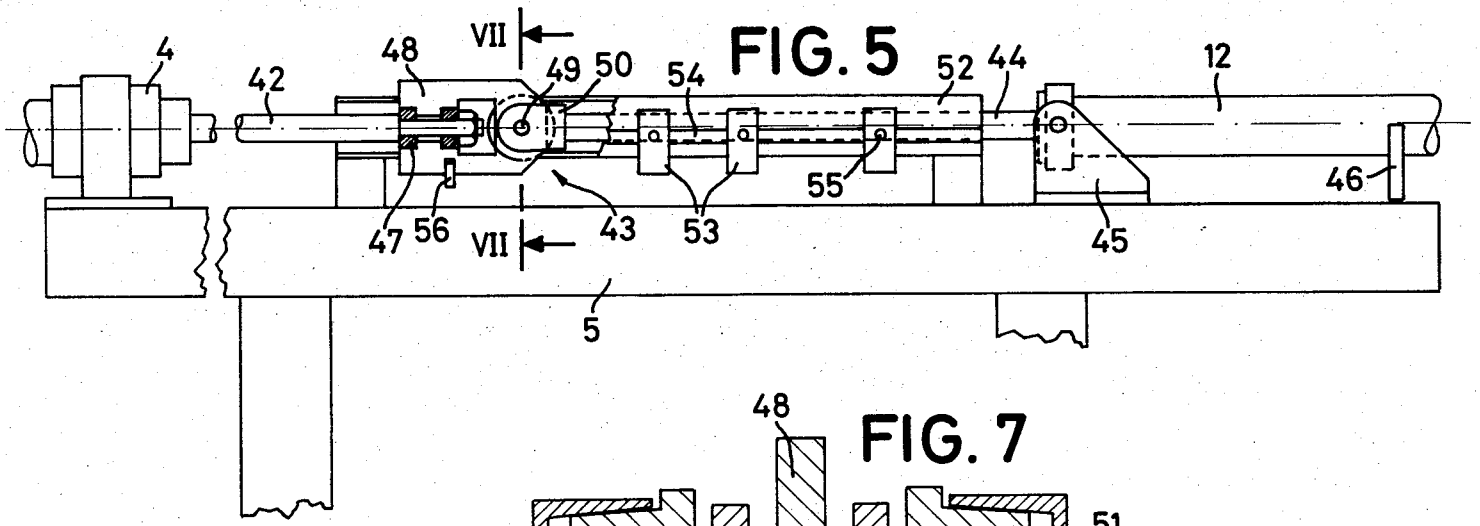
Figure 7:
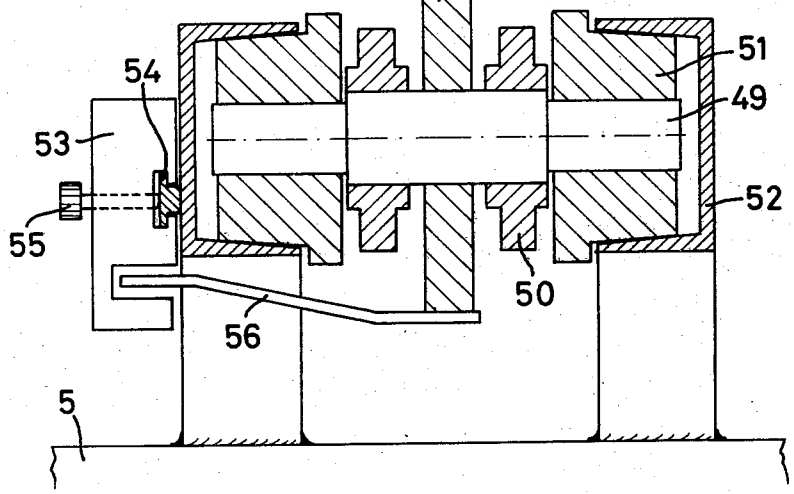

An embodiment of the invention is described below with reference to the drawing wherein:

FIG. 1 is a side view of a machine for the manufacture of reinforcing bodies for concrete pipes, FIG. 2 is a plan view of the machine according to FIG. 1, FIG. 3 is an axial view A of the main disc and of the welding device of the machine according to FIG. 1, FIG. 4 is the side view of the upper half of the main disc of this machine, partly cut away axially, on a larger scale, FIG. 5 is the corresponding side view of the machine part adjoining that of FIG. 4 on the right-hand side, FIG. 6 is a horizontal section VI—VI with the plan view of a guide piece on a larger scale and FIG. 7 is a cross-section VII—VII of the bearing head, again on a larger scale.

The machine will first be described in broad outline with reference to FIGS. 1 to 3. It comprises a main disc 1 and a support disc 2 which conventionally have a diameter of about two to four meters, but could also be even larger. These discs designed as spoked wheels are mounted coaxially and are drivable precisely synchronously by means of an electric drive. The main disc has a hollow shaft 3 which projects to the right or, according to FIG. 3, to the rear and which is mounted in a pillow block 4 on a floor stand 5. The main disc 1 is guided at its outer ring by bearing rollers 6. Further such bearing rollers 6 are arranged also above the main disc on a gantry which is shown in FIG. 3 only and surrounds the main disc 1. The support disc 2 is mounted on a carriage 7 which is movable in an axial direction on two rails 8. It is driven, for example, by means of a gear wheel and a rack built into the rails.

Each of the two discs has twenty-four spokes. A guide piece 9 is displaceable, by means of an endless chain 10, on each spoke of the main disc 1. The chains are moved by means of an annular sleeve 11 which is displaceable on the hollow shaft 3 and which is connected to an axially arranged hydraulic working cylinder 12 via a connecting rod. The guide pieces 9 each have an axial opening into which the longitudinal bars are inserted from the right side through funnels at the start of the manufacturing process. The ends of these longitudinal bars are clamped to the support disc 2 by means of radially adjustable clamping devices 13.

The support disc 2 is situated, in so doing, fully to the right in direct proximity to the main disc 1. While both discs are turning, the support disc 2 moves slowly away from the main disc 1. In so doing, a wire supplied via a guide tube 14 is wound spirally over the longitudinal bars. The wire is welded to the longitudinal bars at each point of intersection by means of a roll welding device 15.

The roll welding device 15 is mounted on a welding carriage 16 which is movable transversely to the machine axis on a horizontal guideway 17. A hydraulic working cylinder 18 serves as a drive element for the welding carriage 16, the arrangement being such that, when the piston rod of this cylinder is retracted, the welding carriage 16 moves radially outwards.

The cylinder compartments, on the side of the piston rod, of the two working cylinders 12 and 18 are connected to one another via a line 19. The other two cylinder compartments are connected to a hydraulic pump 21 and to an oil tank 22 respectively, with the interposition of an electromagnetically actuable four-way reversing valve 20. Further control means, high-pressure relief valves and the like, which are necessary under certain circumstances so that the pistons of the two working cylinders cover the same distances in precise synchronisation, are not expressly illustrated or designated. FIG. 4 shows, of the main disc 1, the hub 23, a spoke 24 and the outer ring 25. The latter carries a race adapted to the profile of the bearing rollers 6 and a toothed rim for the rotary drive. The guide piece 9 illustrated consists, as shown in FIG. 6, of a slidable rectangular sleeve 26 which surrounds the spoke 24 and to which a box-shaped holding body 27 is screwed laterally. A welding rest 29 adjacent the support disc 2 is flanged to said holding body by means of a screw 28 which passes through in the axial direction of the machine. This welding rest has a longitudinal bore which continues to the right in a tube 30 ending in a funnel 31. To produce reinforcing bodies with extremely small diameters, the welding rest 29 can be displaced on the holding body 27 into a second position lying radially further inwards. This position of the screw 28 is suggested by a second broken line.

The chain 10 for adjusting the guide piece 9 is guided via four rollers, of which one 32 is mounted on the outer ring 25, two further ones 33 and 34 are mounted on the hub 23 and the fourth 35 is drawn up to a ring 36 in the manner of a chain tightener by means of a screw, the said ring sitting fixedly on the hollow shaft 3. The endless chain 10 thus constitutes an angle-shaped double strand, one leg of which runs parallel to the spoke 24 and the other leg runs parallel to the axis. The chain strand running over the inner roller 33 is fastened at 37 to the rectangular sleeve 26 of the guide piece 9 and at 38 to the annular sleeve 11. Corresponding endless chains and roller guides are assigned to each of the twenty-four spokes. Thus, if the annular sleeve 11 moves to the right, all the guide pieces 9 travel radially inwards, and vice-versa.

The hollow shaft 3 flanged to the hub 23 has two longitudinal slots 39 lying opposite one another. Through these longitudinal slots pass two crosspins 40 which connect the annular sleeve 11 to a sliding block 41 located on the inside of the hollow shaft 3 and to a connecting rod 42. The pillow block 4 not only supports the hollow shaft 3, but also provides a radial guide for the connecting rod 42.

The arrangement in FIG. 4 is continued in FIG. 5. The connecting rod 42 is connected by means of a bearing head 43 to the piston rod 44 of the drive cylinder 12. This is pivotable at its left end in two bearing lugs 45 about a horizontal axis and rests with its leg 46 loosely on the floor stand 5. The bearing head 43 comprises an axial bearing 47 which ensures the turnability of the connecting rod 42 in relation to a flat connecting piece 48, as well as a transverse joint pin 49 by means of which the fork joint 50 of the piston rod 44 is hinged to the connecting piece 48. The enlarged cross-section of the bearing head 43 according to FIG. 7 shows how the frictional torques originating from the turning of the main disc 1 are absorbed. The joint pins 49 are extended on both sides and carry slightly conical rollers 51 which fit between the legs of two U-shaped rails 52 standing opposite one another in mirror image. These U-shaped rails are fastened to the floor stand 5.

To enable the positions of the guide pieces 9 and of the following welding carriage 16 to be detected, or to enable the drive to be stopped automatically when a certain position is reached, inductive position indicators 53 are arranged on one of the U-shaped rails 52. They are displaceable in the stroke direction on a T-shaped rail 54 and are each lockable by means of a clamping screw 55. A tongue 56 welded to the connecting piece 48 is bent so that its free end engages free of contact into corresponding slots of the position indicators 53. These position indicators act on the hydraulic drive and preferably fulfil the function of limit switches. They can be operated selectively in any combination by means of electrical switching.

I claim:

1. A machine for the manufacture of reinforcing bodies for concrete pipes, having longitudinal bars and wires wound over and welded at the points of intersection of said bars, comprising:

a fixed main disc;

a support disc mounted coaxially and synchronized with the main disc, and displaceable in the axial direction;

guide means carried by and radially displaceable on the main disc, said guide means providing a welding rest for the longitudinal bars;

a carriage transversely displaceable relative to the axis of the discs;

a welding device disposed on the carriage to make welds successively on the longitudinal bars;

traction means engaged to the guide means;

roller means for guiding the traction means into the radial and axial directions;

axially directed hydraulic cylinder means for driving the traction means; and transversely directed hydraulic cylinder means for driving the carriage, synchronized with the axially directed cylinder means such that the guide means and the welding device are radially synchronized.

2. A machine according to claim 1 in which the main disc includes an outer ring and a hub, in which the axially directed cylinder means includes a non-rotating piston rod, in which the roller means comprises a first roller fastened to the outer ring, second and third rollers both fastened to the hub, and a fourth roller, in which the traction means comprises an endless chain guided by the first, second, third and fourth rollers, further comprising:

a hollow shaft having a longitudinal slot, attached at a first end to the main disc and fastened at a second end to the fourth roller;

an annular sleeve fastened to the chain and displaceably mounted on the hollow shaft;

a connecting rod positioned within the slot and projecting out of the shaft at the second end, said rod connected in the slot to the annular sleeve; and an axial bearing for engaging the connecting rod to the piston rod.

3. A machine according to claim 1, wherein along the hydraulic cylinder means is arranged position indicator means for detecting the stroke position of the piston rod, said position indicator means is variably displaceable in the stroke direction.

* * * * *